US007585251B2

(12) United States Patent
Doody, Jr. et al.

(10) Patent No.: US 7,585,251 B2
(45) Date of Patent: Sep. 8, 2009

(54) LOAD VARIANCE SYSTEM AND METHOD FOR EXERCISE MACHINE

(75) Inventors: James M. Doody, Jr., Mill Valley, CA (US); Kevin P. Corbalis, Tustin, CA (US); Gregory Allen Wallace, Mission Viejo, CA (US)

(73) Assignee: Unisen Inc., Irvine, CA (US)

( * ) Notice: Subject to any disclaimer, the term of this patent is extended or adjusted under 35 U.S.C. 154(b) by 720 days.

(21) Appl. No.: 11/000,509

(22) Filed: Nov. 30, 2004

(65) Prior Publication Data

US 2006/0046905 A1 Mar. 2, 2006

Related U.S. Application Data

(60) Provisional application No. 60/605,989, filed on Aug. 31, 2004.

(51) Int. Cl.
*A63B 71/00* (2006.01)
*A63B 21/005* (2006.01)
*A63B 22/06* (2006.01)

(52) U.S. Cl. ..... 482/6; 482/9; 482/63; 482/900

(58) Field of Classification Search ..... 482/4–9, 482/57, 63–64, 1–3, 900, 902
See application file for complete search history.

(56) References Cited

U.S. PATENT DOCUMENTS 3,589,193 A 6/1971 Thornton
3,767,195 A * 10/1973 Dimick ..... 482/5
3,903,613 A 9/1975 Bisberg
4,602,373 A 7/1986 Dorfman
4,709,917 A 12/1987 Yang
4,789,153 A 12/1988 Brown
4,842,274 A * 6/1989 Oosthuizen et al. ..... 482/5
4,938,474 A * 7/1990 Sweeney et al. ..... 482/52
4,938,475 A 7/1990 Sargeant et al.
5,067,710 A 11/1991 Watterson et al.
5,240,417 A 8/1993 Smithson et al.
5,256,115 A 10/1993 Scholder et al.
5,762,584 A 6/1998 Daniels
5,890,995 A 4/1999 Bobick et al.
6,152,856 A 11/2000 Studor et al.
6,749,537 B1 6/2004 Hickman
2003/0045403 A1 3/2003 Watterson et al.
2007/0281828 A1 12/2007 Rice

* cited by examiner

*Primary Examiner*—Steve R Crow
(74) *Attorney, Agent, or Firm*—Knobbe, Martens, Olson & Bear, LLP

(57) ABSTRACT

An exercise machine that varies a resistive load based on sensed changes in intensity of exercise. In one example, an electronic control system of a stationary bicycle adjusts a flywheel resistive load based on changes in the user's pedal cadence. During the exercise routine, subsequent increases or decreases in the pedal cadence cause, respectively, increases or decreases in the flywheel resistive load. In addition, the control system may execute the exercise routine after actuation of a single input key. In another embodiment, the user may simply start to exercise. The electronic control system may calculate a default flywheel resistive load based on initialization parameters, such as demographic data and/or exercise preferences.

22 Claims, 6 Drawing Sheets

LOAD VARIANCE SYSTEM AND METHOD FOR EXERCISE MACHINE

RELATED APPLICATION

This application claims the benefit of priority under 35 U.S.C. § 119(e) of U.S. Provisional Patent Application No. 60/605,989 filed on Aug. 31, 2004, entitled "LOAD VARIANCE SYSTEM AND METHOD FOR EXERCISE MACHINE," the entirety of which is hereby incorporated herein by reference.

BACKGROUND OF THE INVENTION

1. Field of the Invention

The present invention relates to an exercise apparatus having an electronically-controlled resistance and, in particular, a system and method for controlling the pedal resistance of a stationary bicycle.

2. Description of the Related Art

Relatively recent trends towards physical fitness awareness have led to an increase in the number of individuals exercising to keep physically fit. Stationary exercise machines, such as stationary bicycles, have become popular choices for exercise enthusiasts who want to avoid the attendant inconvenience of outdoor exercise. As a result, community fitness centers, hotels, and training facilities generally include various stationary exercise machines to accommodate the needs of their patrons whose modern lifestyles often allow only limited amounts of time to be set aside for exercise.

However, as more sophisticated bicycle simulating equipment has been developed through the years, stationary bicycles designs have taken on more complex designs and operating modes. For example, modern stationary bicycles often afford a plethora of preprogrammed routines or workout options and generally require a user to select a series of inputs when initializing an exercise routine. One major drawback of these more complex designs is that operation of the stationary bicycle has become more confusing and time-consuming for the user.

As a result, the user, and especially a first-time user, generally must spend a substantial amount of time familiarizing himself or herself with a particular exercise machine and setting up his or her exercise routine. For example, even before beginning the exercise routine, a user of a conventional stationary bicycle generally must make various programmatic selections and input various data, such as selecting the appropriate preprogrammed routine, choosing and adjusting the pedal resistance level, and so forth. If the user is not familiar with the exercise machine, these user selections and in-exercise adjustments can be time-consuming and even frustrating. Even if a user manual or operating instructions are provided for assistance, the user must expend time in accessing and reading the manual or in understanding and following the provided instructions.

Furthermore, even if users are is willing to spend the time familiarizing themselves with their own stationary bicycles, those users often exercise away from home, such as in fitness centers and hotels as they travel for business or pleasure. As can be expected, fitness centers and hotels often provide different brands or models of exercise equipment, which generally vary in available programmable options and in their resistance level calculations. In addition, fitness centers and hotels rarely offer travelers access to user manuals. Moreover, even if a user may be familiar a particular brand or model of exercise machine, oftentimes factors such as changes in elevation or physical injury may require the user to substantially change his or her exercise routine.

In addition, once the user begins his or her exercise routine, the user often needs to adjust the workout conditions by selecting among various resistance level controls. For example, the initial resistance level selected by the user is oftentimes too low or too high. Similarly, later in the exercise routine the user may need to adjust resistance levels because of user fatigue or other physical conditions. As can be seen, the user may expend time establishing and maintaining satisfactory exercise conditions for a particular workout, time that could otherwise be spent on physical exercise.

In response to at least some of the foregoing drawbacks, the stationary bicycle industry often includes a manual exercise program, where the user may manually adjust a resistance level control during his or her exercise routine. However, manual programs still suffer from the drawback of a need for user familiarity between the selected resistance level control and the desired application of resistance resulting from the selection. Moreover, manual exercise programs generally apply substantially the same resistance to the user regardless of the user's exercise intensity.

SUMMARY OF THE INVENTION

In view of the foregoing, conventional stationary exercise machines do not provide the user with a straightforward exercise routine usable by operators with no or very little knowledge of the particular programmatic functions of the machine. Accordingly, what is needed is a stationary bicycle that provides the user with a more straightforward exercise routine regardless of the user's familiarity with the stationary bicycle.

Moreover, a need exists for an exercise machine with a straightforward control of exercise intensity during an exercise routine. In an embodiment of the invention, the exercise machine provides the straightforward control. In another embodiment, the exercise machine provides a hands-free exercise routine.

For example, in an embodiment, the user selects a single input key, such as an "autopilot" key, and begins to pedal. If the user believes the pedal resistance is too low, the user pedals faster, and the exercise machine increases the pedal resistance. If the user believes the pedal resistance is too high, the user pedals slower, and the exercise machine decreases the pedal resistance. In an embodiment, the foregoing increases and decreases of the pedal resistance are influenced by, or relate to, the increases and decreases in the user's pedal cadence. For example, in a preferred embodiment, an increase in the pedal cadence relates to an increase in the pedal resistance through a proportional relationship. In a more preferred embodiment, the relation comprises a linear relationship. In an even more preferred embodiment, the relation comprises a non-linear relationship. In an even more preferred embodiment, the relation comprises a polynomial relationship, such as a fourth order polynomial relationship. In another embodiment, the relation may comprise a table or list of pre-determined values.

In one embodiment, the foregoing exercise routine is accomplished on a stationary bicycle including a one-touch control, wherein selection of the one-touch control activates a straightforward exercise routine. In an embodiment, the one-touch control may cause an electronic control system to adjust a pedal resistance based on sensed changes in the pedal cadence. The one-touch control may comprise a single input device located on an electronic display In another embodiment, an electronic control system receives an input from the user to initiate an exercise routine during which the electronic control adjusts a flywheel resistive load based on changes in the user's pedal cadence. In particular, changes in the pedal cadence cause changes in the angular velocity of the flywheel. Upon sensing an increase in the flywheel angular velocity, the control system increases the flywheel resistive load, which increases the pedal resistance felt by the user. Upon sensing a decrease in the flywheel angular velocity, the control system decreases the flywheel resistive load, which decreases the pedal resistance felt by the user. In an embodiment, the increases and decreases in the flywheel resistive load are related to, or are a function of, the increases and decreases of the flywheel angular velocity.

In another embodiment of the invention, an electronic control system receives demographic and/or exercise preference data associated with the user to calculate a default flywheel resistive load. For example, a processor may receive demographic data such as, for example, data regarding the user's weight, age, sex, height, combinations of the same or the like. Exercise preferences may include data regarding general preferred exercise resistance levels (e.g., easy, medium, difficult, most difficult); desired workout parameters such as workout duration, caloric or power expenditure, or distance traveled; a preferred heart rate; combinations of the same or the like. When the user selects a one-touch control indicating the initiating of a customized exercise routine, the processor instructs a resistance mechanism to apply a default resistive load to the flywheel. Subsequent variations in the user's pedal cadence cause the processor to adjust the flywheel resistive load. In another embodiment, the user may adjust the default resistive load by moving to or from a more difficult resistance level, or the like.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

DETAILED DESCRIPTION OF THE PREFERRED EMBODIMENT

Figure 1:
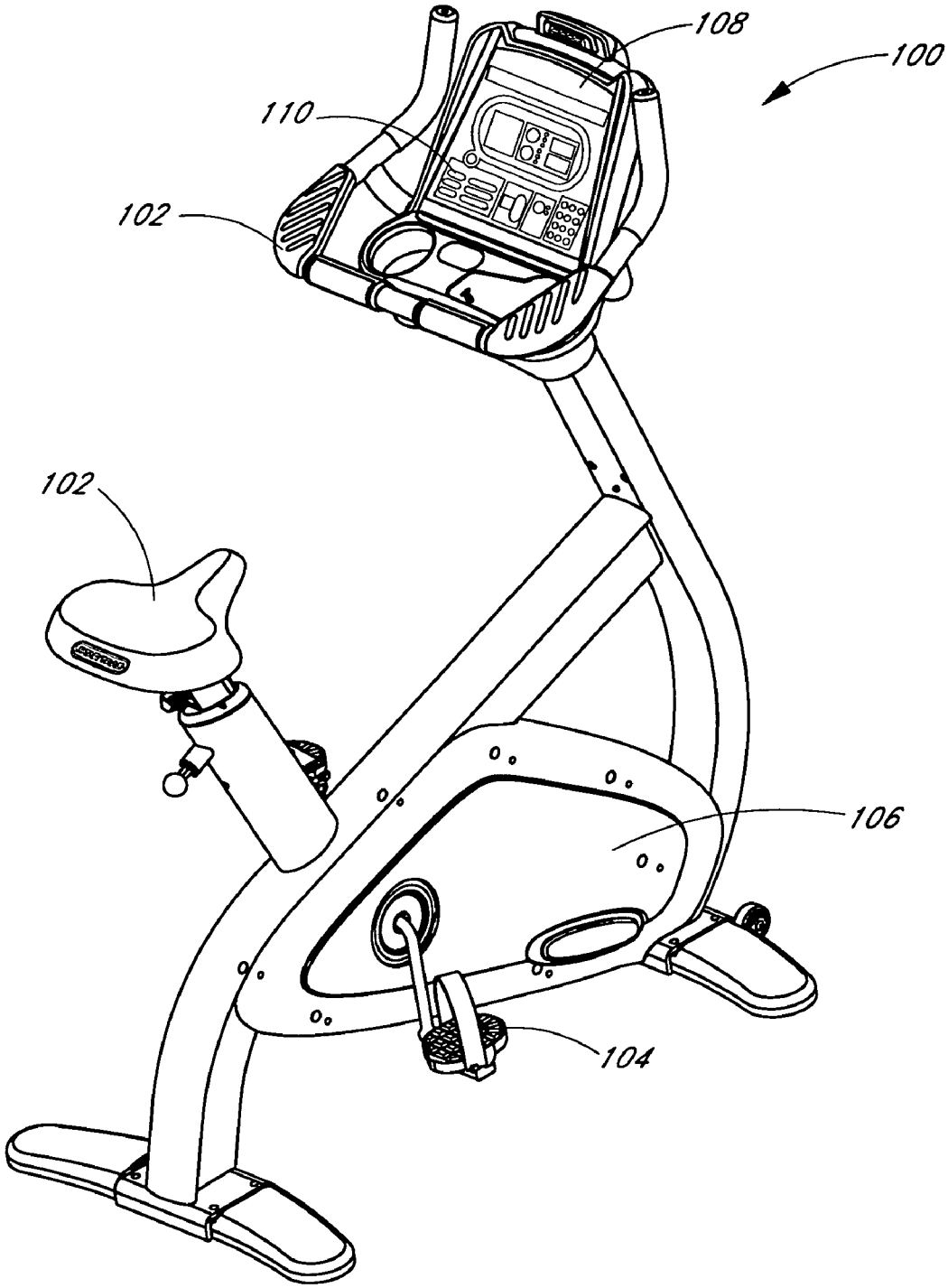
FIG. 1 illustrates a perspective view of an upright stationary bicycle according to one embodiment of the invention.

Traditional stationary exercise machines do not provide the user with a straightforward exercise routine usable by operators with no or very little knowledge of the particular programmatic functions of the machine. Accordingly, what is needed is a stationary bicycle that provides the user with a more straightforward exercise routine even when the user is unfamiliar with the stationary bicycle.

Moreover, a need exists for an exercise machine with a straightforward control of exercise intensity during an exercise routine. In an embodiment of the invention, the exercise machine provides the straightforward control without the need for a user manual. In another embodiment, the exercise machine provides a "hands-free" exercise routine.

The term "hands-free" routine as used herein includes its ordinary broad meaning, which includes an exercise routine that may be performed, or a program that can be executed, based at least in part without substantial use of the user's hands. For example, a hands free routine may adjust or adapt to the intensity of the user's performance, such as for example, how fast the user is pedaling.

For example, in an embodiment, the user selects a single input key, such as an "autopilot" key, and begins to pedal. If the user believes the pedal resistance is too low, the user pedals faster, and the exercise machine increases the pedal resistance. If the user believes the pedal resistance is too high, the user pedals slower, and the exercise machine decreases the pedal resistance. In an embodiment, the foregoing increases and decreases of the pedal resistance relate to the increases and decreases in the user's pedal cadence. For example, the magnitudes of the increases and decreases of the pedal resistance may be a function of the magnitudes of the respective increases and decreases in the user's pedal cadence.

The term "cadence" as used herein includes its ordinary broad meaning, which relates to the beat, time or measure of a rhythmic or repetitive motion or activity. For example, as used herein, the pedal cadence of a stationary bicycle relates to the rotational velocity of the pedals, which is typically measured in revolutions per minute.

In one embodiment, the foregoing exercise routine is accomplished on a stationary bicycle including a one-touch control, wherein selection of the one-touch control activates a straightforward exercise routine. In an embodiment, the one-touch control may cause an electronic control system to adjust a pedal resistance based on sensed changes in the pedal cadence. For example, the one-touch control may comprise a single input device located on an electronic display.

An electronic control system may advantageously apply a default resistance to a user. When the control system senses an increase in the intensity of the exercise, such as when the user pedals faster, the control system can increase the resistive load, which increases the pedal resistance felt by the user. Similarly, when the control system senses a decrease in the exercise intensity, the control system can decrease the resistive load, which decreases the pedal resistance felt by the user.

In an embodiment, an electronic control system uses demographic data associated with the user to calculate the foregoing default resistance. For example, a user may enter demographic information and/or exercise preferences. Demographic information may advantageously include data regarding the user's weight, age, sex, height, other demographic data an artisan may find useful in setting a resistive load, combinations of the same or the like. Exercise preferences may include data regarding general preferred exercise resistance levels; desired workout parameters such as workout duration, caloric or power expenditure, or distance traveled; a target, interval or preferred heart rate; combinations of the same or the like.

As discussed, once a default resistance is chosen, the electronic control system advantageously adjusts the resistance as the user's exercise cadence changes. In an embodiment, the change in resistance relates to the change in exercise cadence. For example, the magnitude of the change in resistance may be a function of the magnitude of the change in exercise cadence. In other embodiments, the user can adjust the default resistance up or down during exercise. In yet another embodiment, the electronic control system may advantageously store the default resistance values for a particular user, and alterations thereof.

The features of the system and method will now be described with reference to the drawings summarized above. Throughout the drawings, reference numbers are re-used to indicate correspondence between referenced elements. The drawings, associated descriptions, and specific implementation are provided to illustrate embodiments of the invention and not to limit the scope of the invention.

FIG. 1 illustrates an exercise machine 100 comprising a stationary bicycle according to one embodiment of the invention. In particular, the stationary bicycle comprises a stationary, upright exercise bicycle. In other embodiments, the exercise machine may advantageously comprise other exercise machines having electronically controlled resistance mechanisms, such as, for example, stairclimbers, natural runners, elliptical machines and the like.

As shown in FIG. 1, the exercise machine 100 comprises rider positioning mechanisms 102, such as, for example, a handlebar and a seat, a resistance applicator 104, such as pedals, an electronically controlled resistance mechanism 106 (not shown), and an interactive display 108.

FIG. 1 also illustrates a particular innovative structure for the exercise bicycle, comprising two curved center posts combined to provide a more comfortable, ergonomic, stylish, and approachable design. The bicycle may also advantageously include inline skate-style pedal straps that facilitate user adjustments and that provide a more secure hold during cycling.

As will be understood by a skilled artisan from the disclosure herein, a user can sit on the seat, optionally balance using the handlebars, and perform exercises by pedaling the pedals similar to riding a road-going bicycle.

In one embodiment, the display 108 provides feedback on various exercise parameters, including, for example, current and aggregate data related to the current or historical workout. As shown in FIG. 1, the display 108 also provides for user input, such as, for example, the selection of a particular exercise routine, a resistance level, and other user-related data.

Moreover, FIG. 1 depicts the display 108 including an "autopilot" or one-touch control 110. In an embodiment, the one-touch control 110 provides the user with a program selection for initiating a straightforward exercise routine. For example, the one-touch control 110 may initiate an "autopilot" workout program in which changes in pedal resistance are based on changes in pedal cadence.

Figure 2:
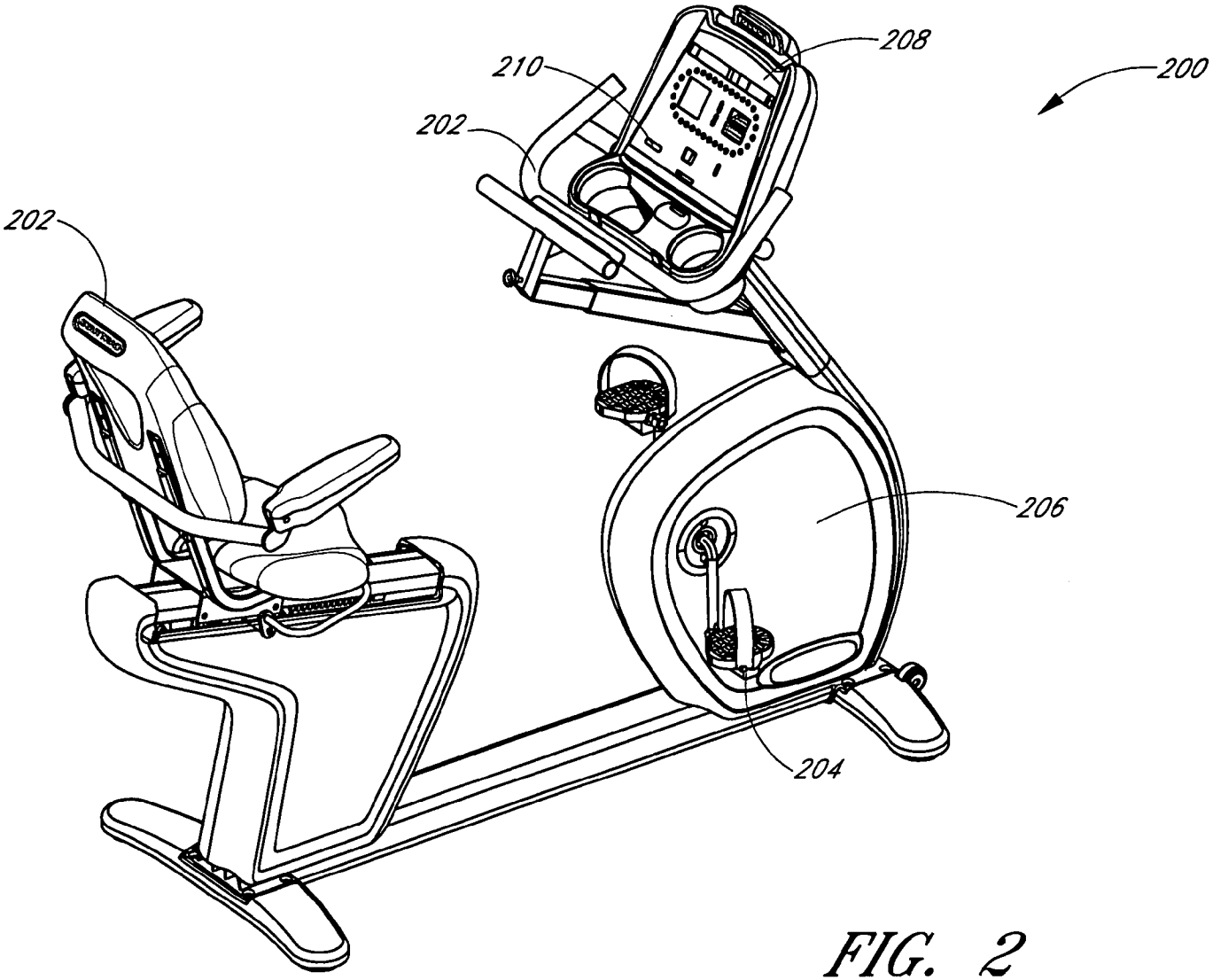
FIG. 2 illustrates a perspective view of a recumbent stationary bicycle according to one embodiment of the invention.

FIG. 2 illustrates an exercise machine 200 comprising a stationary, recumbent exercise bicycle. As shown in FIG. 2, the exercise machine 200 comprises rider positioning mechanisms 202, a resistance applicator 204, an electronically controlled resistance mechanism 106 (not shown), and an interactive display 208, each similar in function to those of FIG. 1. As shown in FIG. 2, the display 208 further comprises a one-touch control 210.

Figure 3:
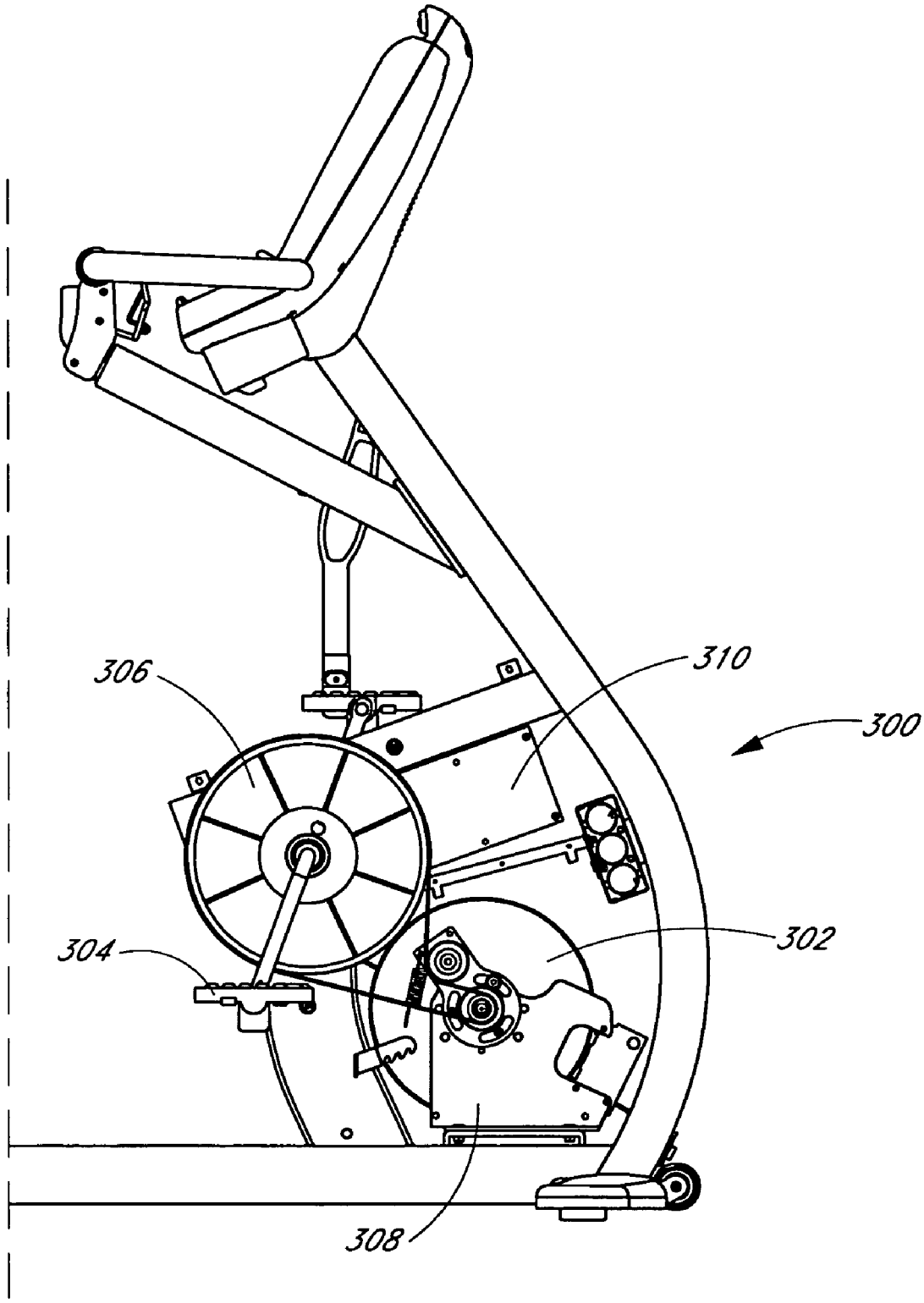
FIG. 3 illustrates a side view of an exemplary embodiment of an electronically controlled resistance mechanism usable by the stationary bicycles of FIGS. 1 and 2.

FIG. 3 illustrates further details of an electronically controlled resistance mechanism 300 used by exercise machines, such as those exercise machines of FIGS. 1 and 2. As shown in FIG. 3, the electronically controlled resistance mechanism 300 comprises a flywheel 302, a resistance applicator 304, such as pedals, a crank 306, a rotational resistance device 308, such as, for example, an electromagnetic device, and a load control board 310.

As illustrated, the flywheel 302 is operatively coupled to the resistance applicator 304 and the crank 306. A user-applied force to the resistance applicator 304, such as through a pedaling motion, causes rotation of the crank 306, which in turn causes rotation of the flywheel 302. The rotational resistance device 308 applies a resistive load to the flywheel 302, which translates back to a resistance at the pedals. Thus, as the rotational resistance device 308 increases the applied resistive load, a user encounters a greater resistance at the pedals and must exert more force to rotate them.

In an embodiment, the load control board 310 communicates with the rotational resistance device 308 to adjust the resistive load to the flywheel 302. The load control board 310 preferably receives at least one control signal, such as from a processor, indicative of the resistive load to be applied by the rotational resistance device 308. In one embodiment, the load control board 310 translates a signal from the processor into a signal capable of affecting the resistance device 308. A skilled artisan will recognize from the disclosure herein that the load control board 310 may advantageously include amplifiers, feedback circuits, and the like, usable to control the applied resistance to the manufacturer's tolerances. In other embodiments, the load control board 310 forwards the received signal to the rotational resistance device 308.

Although disclosed with reference to one embodiment, a skilled artisan will recognize from the disclosure herein a wide variety mechanisms, devices, logic, software, combinations of the same, or the like, usable to control the application of the resistive load. For example, the load control board 310 may comprise a processor or a printed circuit board. In yet other embodiments, the resistance mechanism 300 may operate without a load control board 310. For example, the rotational resistance device 308 may receive a control signal directly from a processor located in the display or in other locations on the exercise machine.

As will be understood by a skilled artisan from the disclosure herein, the rotational resistance device 308 may comprise any device or apparatus usable to apply a resistive load to the flywheel. For example, the rotational resistance device 308 may comprise an electromagnetic device that applies a resistive load by a generating an electromagnetic field. The magnitude of the electromagnetic field corresponds to a field coil current induced by the load control board 310.

Although FIG. 3 illustrates the foregoing electronically controlled resistance mechanism 300, the skilled artisan will recognize from the disclosure herein other resistance mechanisms usable to adjust a resistance felt by a user while performing an exercise routine on an exercise machine. For example, the resistance mechanism 300 may advantageously be suited to the type of exercise device and the particular structures used to cause a user to perform exercises.

Figure 4:
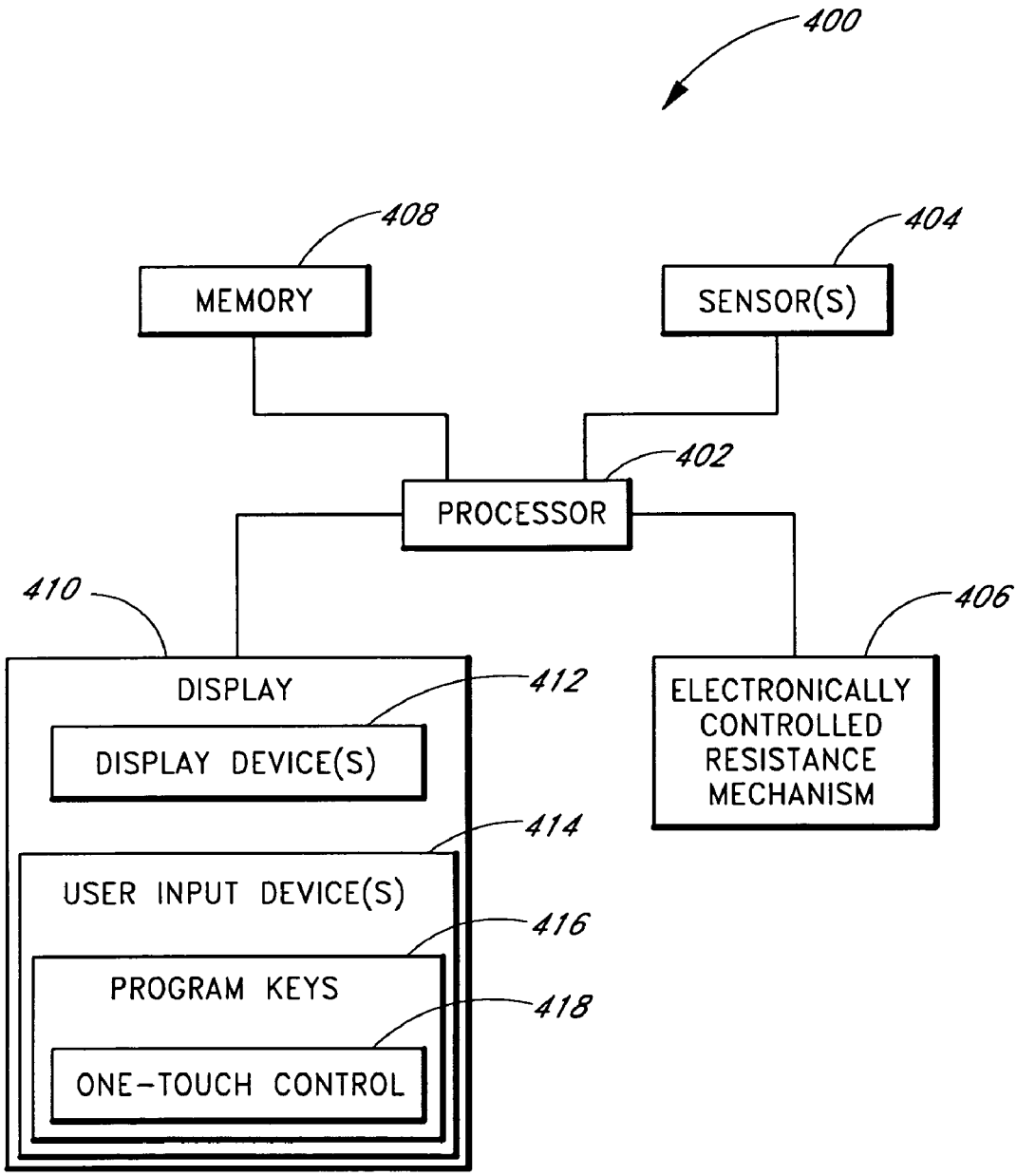
FIG. 4 illustrates a block diagram of an exemplary embodiment of a control system of the stationary bicycles of FIGS. 1 and 2.

FIG. 4 illustrates a block diagram of an exemplary embodiment of a control system 400 usable by an exercise machine, such as the exercise machines 100 and 200 of FIGS. 1 and 2. As shown, the control system 400 comprises a processor 402 that communicates with at least one sensor 404, an electronically controlled resistance mechanism 406, a memory 408, and a display 410.

In an embodiment, the processor 402 comprises a general or a special purpose microprocessor and communicates with the at least one sensor 404 to receive input relating to the operation of the exercise machine. In an embodiment, the sensor 404 provides the processor 402 with a signal indicative of the user's cadence while performing one or more exercises. For example, the sensor 404 may output a signal indicative the user's pedal cadence, or pedal speed, while riding a stationary exercise bicycle. In an embodiment the sensor 404 generates a tach pulse each partial or full revolution of the flywheel 302. By examining the amount of time that passes between each tach pulse, the processor 402 is able to determine the angular velocity, and any changes in the velocity, of the flywheel 302.

Although disclosed with reference to one embodiment, a skilled artisan will recognize from the disclosure herein that the sensor 404 may be any device known to an artisan to measure exercise cadence. For example, the sensor 404 may be capable of measuring the angular velocity of the flywheel, the movement or rotation of the resistance mechanism 406, the force applied by the user, combinations of the same, or the like. The sensor 404 may comprise an optical sensor, a magnetic sensor, a potentiometer, combinations of the same or the like, and may employ one or more encoding devices, such as, for example, one or more rotating magnets, encoder disks, combinations of the same or the like.

As shown in FIG. 4, the processor 402 also communicates with the electronically controlled resistance mechanism 406. In an embodiment, the processor 402 outputs a control signal to adjust the amount of resistance applied by resistance mechanism 406. For example, the processor 402 may output the control signal based on input received from the display 410 and/or the sensor 404.

In an embodiment, the processor 402 communicates with the memory 408 to retrieve and/or to store data and/or program instructions for software and/or hardware. The memory 408 may store information regarding exercise routines, user profiles, and variables used in calculating the appropriate resistive load to be applied by the resistance mechanism 406. As will be understood by a skilled artisan from the disclosure herein, the memory 408 may comprise random access memory (RAM), ROM, on-chip or off-chip memory, cache memory, or other more static memory such as magnetic or optical disk memory. The memory 408 may also access and/or interact with CD-ROM data, personal digital assistants (PDAs), cellular phones, laptops, portable computing systems, wired and/or wireless networks, combinations of the same or the like.

Furthermore, FIG. 4 illustrates the processor 402 communicating with the display 410. The display 410 can have any suitable construction known to an artisan to display information and/or to motivate the user about current or historical exercise parameters, progress of the user's workout, and the like. In one embodiment, the display 410 advantageously comprises an electronic display.

Although the processor 402, the sensor 404, the resistance mechanism 406, the memory 408, and the display 410 are disclosed with reference to particular embodiments, a skilled artisan will recognize from the disclosure herein a wide number of alternatives for the processor 402, the sensor 404, the resistance mechanism 406, the memory 408, and the display 410. For example, the processor 402 may comprise an application-specific integrated circuit (ASIC) or one or more modules configured to execute on one or more processors. The modules may comprise, but are not limited to, any of the following: hardware or software components such as software object-oriented software components, class components and task components, processes, methods, functions, attributes, procedures, subroutines, segments of program code, drivers, firmware, microcode, applications, algorithms, techniques, programs, circuitry, data, databases, data structures, tables, arrays, variables, or the like.

Furthermore, as illustrated in FIG. 4, the processor 402 communicates with the display 410 to provide user output through at least one display device 412 and to receive user input through at least one user input device 414. For instance, the display device 412 may provide the user with information relating to his or her exercise routine, such as for example, the selected preprogrammed workout, the user's cadence, the time expended or remaining in the exercise routine, the simulated distance remaining or traveled, the simulated velocity, the user's heart rate, a combination of the same or the like. The display device 412 may comprise, for example, light emitting diode (LED) matrices, a 7-segment liquid crystal display (LCD), a motivational track, a combination of the same and/or any other device or apparatus that is used to display information to a user.

Furthermore, the user may input information, such as, for example, initialization data or resistance level selections, through at least one user input device 414 of the display 410. Such initialization data may include, for example, the weight, age, and/or sex of the user, the exercise routine selections, other demographic information, or the like. In fact, an artisan will recognize from the disclosure herein a wide variety of data usable to calculate exercise progress or parameters. The user input device 414 may comprise, for example, buttons, keys, a heart rate monitor, a touch screen, PDA, cellular phone, or the like. Moreover, an artisan will recognize from the disclosure herein a wide variety of devices usable to collect user input.

As shown in FIG. 4, the at least one input device 414 comprises program keys 416. In an embodiment, the program keys 416 comprise user-selectable inputs that identify particular preset programs. For example, when the user selects a certain program key 416, the display 410 outputs to the processor 402 a signal identifying the user-selected program, which corresponding program may be stored in the memory 408. A skilled artisan will recognize from the disclosure herein a wide variety of preprogrammed routines that may be associated with the program keys 416.

FIG. 4 also illustrates the program keys 416 comprising a one-touch control 418. In one embodiment, selection of the one-touch control 418 causes the processor 402 to initialize a hands-free, or autopilot, workout program, during which the resistance applied by the resistance mechanism 406 varies according to the intensity of the user's exercise. In one embodiment, actuation of the one-touch control 418 causes the processor 402 to control the flywheel resistive load applied by the resistance mechanism 406 based on sensed changes in the user's pedal cadence.

Figure 5:
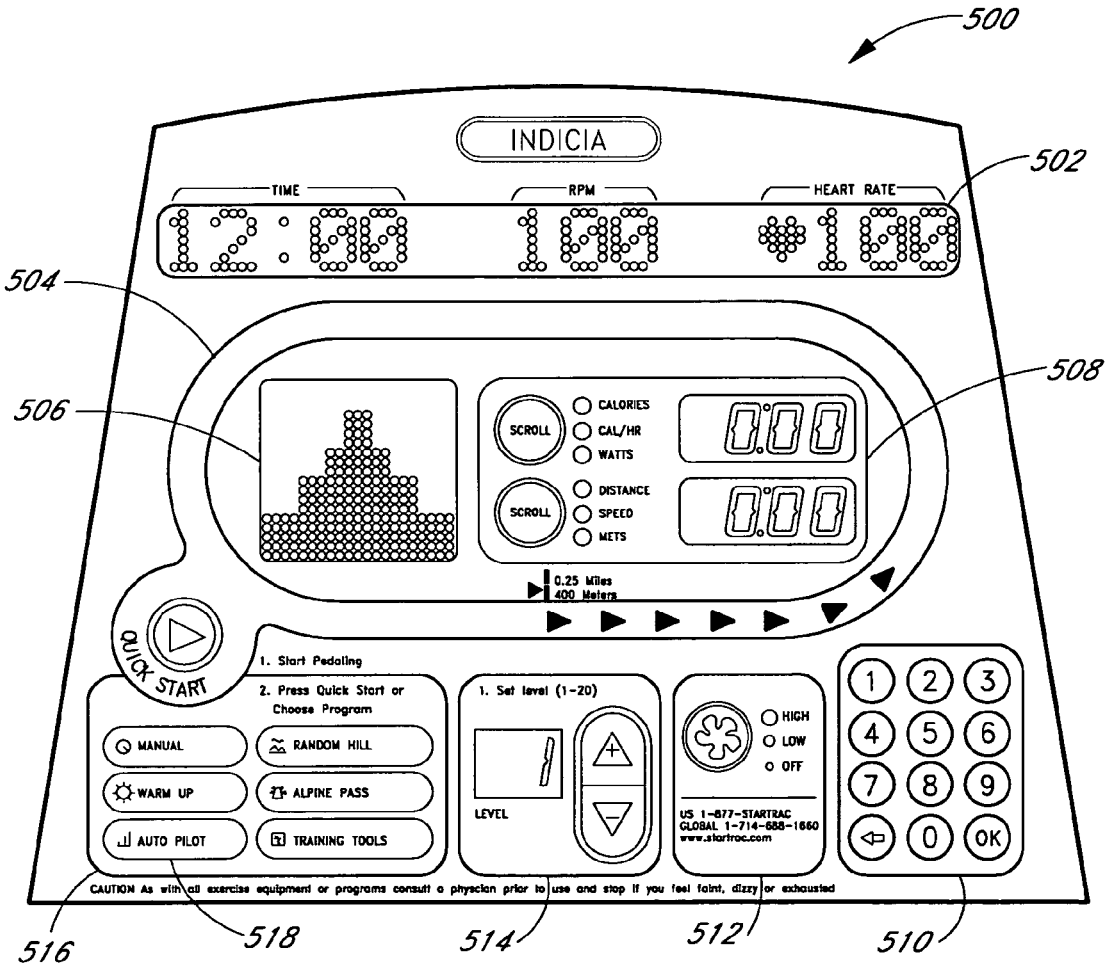
FIG. 5 illustrates an exemplary embodiment of an electronic display of the stationary bicycles of FIGS. 1 and 2.

FIG. 5 illustrates an exemplary embodiment of an electronic display 500 usable by exercise machines 100 and 200 of FIGS. 1 and 2. As shown, the display 500 includes a message window 502, a motivational track 504, a profile window 506, and information windows 508 that are capable of providing information to a user. In addition, FIG. 5 shows the display 500 comprising a numeric keypad 510, a fan control 512, a resistance level control 514 and program keys 516, which are capable of receiving input from the user.

FIG. 5 shows the message window 502 displaying information regarding the duration of a workout, the user's pedal cadence in revolutions per minute (RPM), and the heart rate of a user. In other embodiments, the message window 502 may provide informational messages to the user, instructions during program initialization, feedback during the exercise routine, and summaries of workout data when the user completes the routine.

Furthermore, FIG. 5 illustrates the motivational track 504, which provides the user with his or her progress throughout the exercise routine, the profile display 506, which illustrates simulated terrain changes during the routine, and the information window 508, which displays current and aggregate data related to the current workout, such as calories expended, the distance traveled, and the current speed.

The illustrated display 500 also comprises the numeric keypad 510 usable to enter specific values for exercise parameters or like data, the fan control 512 usable to manually control the operation of a personal cooling fan, and the resistance level control 514, usable to manually increase or decrease the resistance level of an exercise routine.

FIG. 5 further illustrates the display 500 comprising multiple program keys 516 usable to select a desired preset program. In an embodiment, selection of a particular program key 516 initiates a preset workout program. For example, program keys 516 may comprise: a "warm up" key that provides the user with resistance level settings designed to warm-up the user's muscles prior to working out; a "random hill" key that provides the user with exercise routines that simulate riding on hills; an "alpine pass" key that provides the user with an exercise routine that includes a multi-peak ride; and a "training tools" key that provides the user with an opportunity to exercise in particular heart rate zones or watt ranges or to complete a preprogrammed fitness test. A skilled artisan will recognize from the disclosure herein a wide variety of preset programs that may be associated with the program keys 516.

According to one embodiment, the program keys 516 also comprise an "autopilot" key 518. The "autopilot" key 518 is a one-touch control that provides the user with a straightforward exercise routine. For example, selection of the "autopilot" key 518 may initiate a workout program that varies the resistance felt by the user upon sensed changes in the intensity of the user's exercise performance. In one embodiment, a control system increases the pedal resistance in response to changes in the user's pedal cadence. That is, as the user increases his or her pedal cadence, the control system increases the pedal resistance. As the user decreases his or her pedal cadence, the control system decreases the pedal resistance.

A skilled artisan will recognize from the disclosure herein a wide variety of straightforward exercise routines that may be associated with the "autopilot" key. For example, a control system may calculate and apply a default resistive load based on demographic data or other input from the user. The control system may then vary the resistive load based on sensed changes in the user's cadence while performing the exercise routine. In one embodiment, the load variance may relate to the changes in the user cadence. For example, the magnitude of the load variance may be a function of the magnitude of the change in the user's cadence. This function may be based on one or more of a wide variety of predefined correlations, such as, for example, a proportional relationship (i.e., if the user doubles his or her cadence, the control system increases two-fold the resistive load, thus causing the user to feel twice the pedal resistance); a linear relationship; a non-linear relationship (e.g., exponential relationship, polynomial, differential equation, third- or fourth-order equation, or higher order polynomial); a table or list of pre-determined values; combinations of the same or the like.

Figure 6:
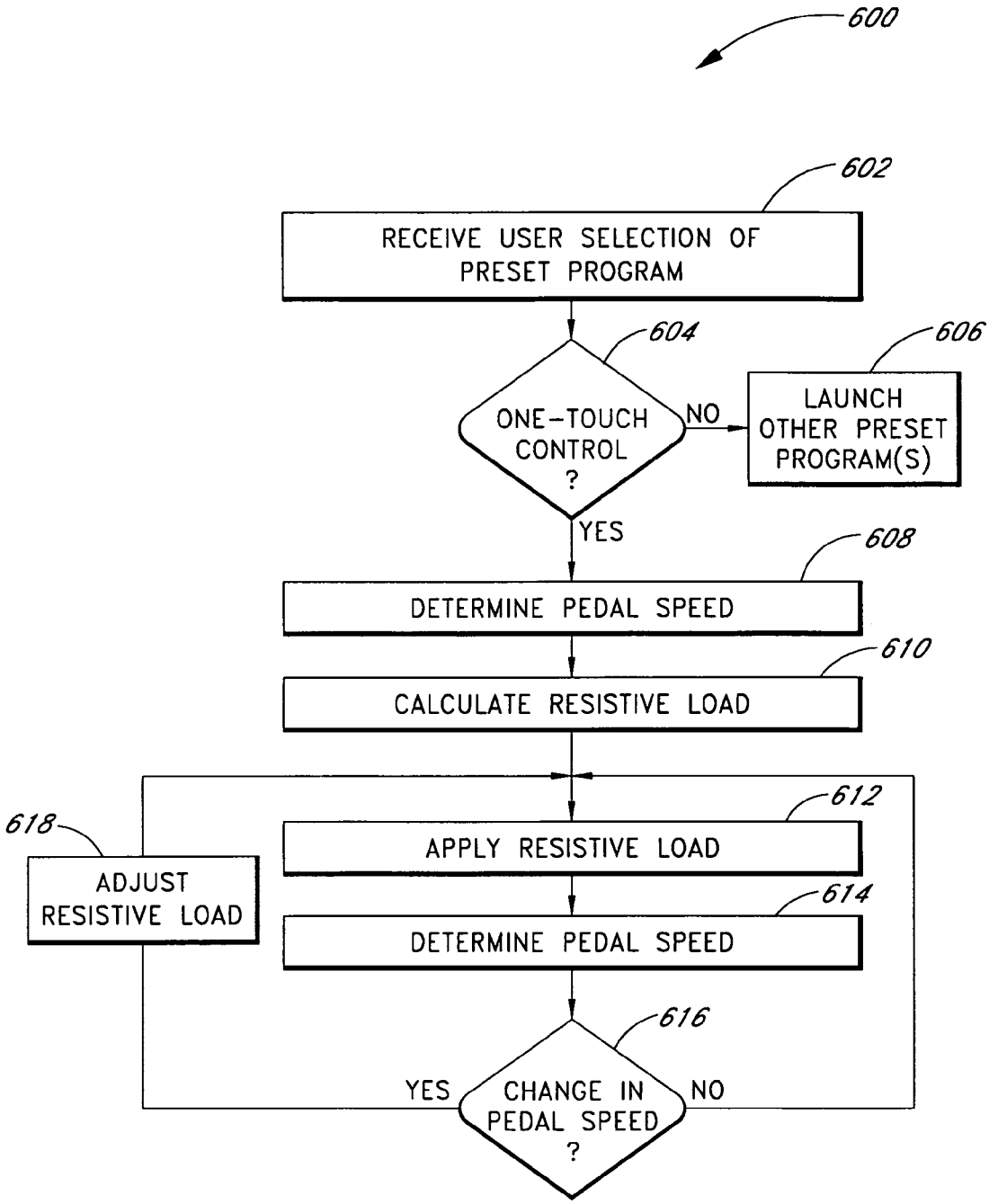
FIG. 6 illustrates a simplified flowchart of an exemplary embodiment of a resistance control process.

FIG. 6 illustrates a simplified flowchart of a resistance control process 600 executable by the control system 400 of FIG. 4. As shown in FIG. 6, the process 600 begins with Block 602, wherein the control system 400 receives a user selection of a preset program. In an embodiment, the user selects the preset program through one of the program keys 516 of the display 500.

The process 600 then proceeds to Block 604 wherein the processor 402 of the control system 400 determines if the user selected a one-touch control, such as the "autopilot" key 518 of FIG. 5. If the user did not select the one-touch control, the processor 402 in Block 606 launches another preset program, such as one described above with reference to the program keys 518 of FIG. 5. On the other hand, if the user did select the one-touch control, the process 600 proceeds to Block 608.

At Block 608, the control system 400 determines the pedal speed, or pedal cadence, of the user. In an embodiment, the processor 402 calculates the pedal speed from at least one signal received from the sensor 404. For example, the sensor 404 may be capable of outputting to the processor 402 a signal that is indicative of the rotational velocity of the flywheel 302, which rotational velocity correlates to the pedal speed of the user. In other embodiments, the sensor 404 senses rotation or movement of other components of the exercise machine, such as, for example, the pedals 304 or the crank 306. A skilled artisan will recognize from the disclosure herein a wide variety of ways and devices usable to measure and/or determine the pedal speed of the user.

The process 600 proceeds to Block 610, wherein the processor 402 calculates the resistive load to be applied. In an embodiment, the processor 402 calculates a default resistive load based on initialization data, such as data entered by the user or data stored in the memory 408. For example, the processor 402 may calculate a default resistive load based on demographic data, such as information relating to the user's age, weight, height, sex, combinations of the same or the like. Furthermore, the processor 402 may receive input regarding the user's exercise preferences, such as, for example, a user selection of a general preferred exercise resistance level (e.g., easy, medium, difficult, most difficult). In yet another embodiment, the processor 402 calculates the default resistive load without any input from the user. Moreover, a skilled artisan will recognize from the disclosure herein a wide variety of data and information usable to calculate a resistive load.

After calculating the resistive load, the resistance mechanism 406 of the control system 400 applies the resistive load, as shown in Block 612. In one embodiment, the resistance mechanism 406 applies a resistive load to the flywheel 302, which resistive load is translated back to the pedals 304.

The process 600 then moves to Block 614, wherein the control system 400 again determines the pedal speed. At Block 616, the control system 400 determines if the pedal speed has changed since the previous determination. In one embodiment, the processor 402 identifies variations in the pedal speed that exceed a certain threshold. For example, the processor 402 may detect changes in pedal speed that exceed two percent. Changes in pedal speed that do not exceed this threshold are filtered out. In yet other embodiments, other threshold values may be used, such as thresholds less than two percent or thresholds greater than two percent. For instance the processor 402 may determine there has been a change in pedal speed when any detectable variation is sensed.

If the pedal speed has not changed, the process 600 returns to Block 612 to apply the resistive load. On the other hand, if the pedal speed has changed, the process 600 proceeds to Block 618 wherein the control system 400 adjusts the resistive load. In one embodiment, the control system 400 adjusts the resistive load as a function of the sensed change in the pedal speed. For example, if the pedal speed increased by fifty percent, the processor 402 may instruct the resistance mechanism 406 to increase the resistive load fifty percent or another amount based on a predetermined function or table. Likewise if the pedal speed decreased by a particular amount, the processor 402 would instruct the resistance mechanism 406 to decrease the resistive by the corresponding, predetermined amount.

A skilled artisan will recognize from the disclosure herein a wide variety of ways or calculations useable to adjust a resistive load in response to sensed changes in pedal speed. For example, the correlation between sensed changes in the pedal speed and the load variance may have a linear or exponential relationship. In other embodiments, the correlation between sensed changes in the pedal speed and the load variance may not be proportional or may be determined from preprogrammed variables or stored tables. After the control system calculates the new resistive load, the process 600 returns to Block 612 to apply the adjusted resistive load.

A skilled artisan will recognize from the disclosure herein that the blocks described with respect to the foregoing process 600 are not limited to any particular sequence, and the blocks relating thereto can be performed in other sequences that are appropriate. For example, described blocks may be performed in an order other than that specifically disclosed or may be executed in parallel, or multiple blocks may be combined in a single block. For instance, the control system may execute Block 610, wherein the processor 402 calculates a resistive load, prior to Block 608, wherein the processor 402 determines the user's pedal speed. In addition, not all blocks need to be executed or additional blocks may be included without departing from the scope of the invention.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A stationary bicycle configured for straightforward operation that reduces user interaction with one or more exercise routines, the stationary bicycle comprising:

a flywheel;

a rotatable crank connected to the flywheel, wherein rotation of the crank translates into rotation of the flywheel;

pedals rotatably attached to the crank;

an electronically controlled resistance device configured for interacting with the flywheel to apply resistance to the flywheel based on electronic control, wherein the resistance is translated back to the pedals causing a user to exercise;

a sensor configured for outputting a first signal indicative of a first pedal velocity at a first time, a second signal indicative of a second pedal velocity at a second time, and a third signal indicative of a third pedal velocity at a third time, wherein the second time follows the first time and the third time follows the second time; and at least one processor configured for controlling the resistance applied to the flywheel without receiving data input by the user indicative of a target flywheel resistance or target velocity of the flywheel prior to or during the exercise, the at least one processor configured for receiving the first and second signals and, when the second pedal velocity time at the second time is greater than the first pedal velocity at the first time, outputting one or more first control signals causing the electronically controlled resistance device to apply more resistance to the flywheel based on the increase in pedal velocity between the first time and the second time, when the second pedal velocity at the second time is less than the first pedal velocity at the first time, outputting the one or more first control signals causing the electronically controlled resistance device to apply less resistance to the flywheel based on the decrease in pedal velocity from the first time to the second time, and when the second pedal velocity at the second time is substantially the same as the first pedal velocity at the first time, outputting the one or more first control signals causing the electronically controlled resistance device to maintain the same resistance to the flywheel as applied at the first time, and wherein the at least one processor is further configured for receiving the third signal and, when the third pedal velocity time at the third time is greater than the second pedal velocity at the second time, outputting one or more second control signals causing the electronically controlled resistance device to apply more resistance to the flywheel based on the increase in pedal velocity between the second time and the third time, when the third pedal velocity at the third time is less than the second pedal velocity at the second time, outputting the one or more second control signals causing the electronically controlled resistance device to apply less resistance to the flywheel based on the decrease in pedal velocity from the second time to the third time, and when the third pedal velocity at the third time is substantially the same as the second pedal velocity at the second time, outputting the one or more second control signals causing the electronically controlled resistance device to maintain the same resistance to the flywheel as applied at the second time.

2. The stationary bicycle of claim 1, wherein a magnitude of said increase or decrease in resistance is a function of a magnitude of said increase or decrease in the pedal velocity.

3. The stationary bicycle of claim 1, wherein said sensor is configured to output said first signal based on an angular velocity of the flywheel.

4. The stationary bicycle of claim 1, wherein the electronically controlled resistance device comprises an electromagnetic device.

5. The stationary bicycle of claim 1, wherein said at least one processor outputs one or more fourth control signals in response to a user selection of an exercise routine.

6. The stationary bicycle of claim 5, wherein the exercise routine is a one-touch exercise routine.

7. The stationary bicycle of claim 5, further comprising a display configured for receiving said user selection.

8. The stationary bicycle of claim 1, wherein the one or more first, second and third control signals are received directly by the electronically controlled resistance device.

9. The stationary bicycle of claim 1, wherein two pedal velocities are substantially the same when a change between the two pedal velocities is less than about two percent (2%).

10. A control system for an exercise machine, the control system comprising:

an input device configured for outputting a first signal indicative of a selection of a hands-free exercise routine for an exercise device, wherein the exercise device is operated at a cadence during a performance of one or more exercises;

a sensor capable of outputting a second signal indicative of the cadence at a first time during the performance of the one or more exercises and a third signal indicative of the cadence at a second time during the performance of the one or more exercises;

a resistance mechanism configured for applying a resistance during the performance of the one or more exercises; and one or more processors configured for controlling the applied resistance without receiving data input by a user indicative of a target resistance or target pedal velocity prior to or during the performance of the one or more exercises, the one or more processors being further configured for receiving said first, second and third signals and instructing the resistance mechanism to control the applied resistance based at least in part on a comparison of said second and third signals, wherein when the cadence at the second time is greater than the cadence at the first time, outputting one or more first control signals causing the resistance mechanism to apply more resistance based on the increase in cadence from the first time to the second time, and when the cadence at the second time is less than the cadence at the first time, outputting the one or more first control signals causing the resistance mechanism to apply less resistance based on the decrease in cadence from the first time to the second time, and wherein the one or more processors are further configured for maintaining substantially the same applied resistance between any two consecutively measured times when the cadence during the performance of the one or more exercises remains substantially the same between the two consecutively measured times independent of the magnitude of the cadence during the two consecutively measured times.

11. The control system of claim 10, wherein the input device is located on an electronic display.

12. The control system of claim 10, wherein the input device comprises a one-touch actuator.

13. The control system of claim 10, wherein the increase in the applied resistance is a function of the increase in the cadence.

14. The control system of claim 10, wherein the one or more exercises comprises a stationary cycling exercise.

15. The control system of claim 14, wherein the cadence comprises a pedal cadence.

16. The control system of claim 10, wherein the one or more processors are configured to disregard a variance between two cadences that is less than a predetermined threshold.

17. The control system of claim 16, wherein the predetermined threshold is approximately two percent (2%).

18. An exercise apparatus capable of straightforward operation that reduces user interaction with one or more exercise routines, the exercise apparatus comprising:

means for receiving a user-applied force during the performance of one or more exercises, wherein said means for receiving is configured to be operated at a cadence during said one or more exercises;

means for applying a resistive load that is translated to said means for receiving;

means for sensing said cadence of said means for receiving, wherein said means for sensing is capable of outputting a first signal indicative of said cadence at a first time, a second signal indicative of said cadence at a second time and a third signal indicative of said cadence at a third time; and means for controlling the applied resistive load without receiving user input indicative of a target resistance prior to or during the one or more exercises, said means for controlling being further configured for processing said first and second signals and for outputting one or more first control signals causing said means for applying the resistive load to:

when the cadence at the second time is different than the cadence at the first time, cause said means for applying the resistive load to apply more or less resistance based on, respectively, the increase or decrease in cadence from the first time to the second time, and when the cadence at the second time is substantially the same as the cadence at the first time, cause said means for applying the resistive load to maintain the same resistance as applied at the first time, and wherein said means for controlling is further configured for processing said second and third signals and for outputting one or more second control signals causing said means for applying the resistive load to:

when the cadence at the third time is different than the cadence at the second time, cause said means for applying the resistive load to apply more or less resistance based on, respectively, the increase or decrease in cadence from the second time to the third time, and when the cadence at the third time is substantially the same as the cadence at the second time, cause said means for applying the resistive load to maintain the same resistance as applied at the second time.

19. The exercise apparatus of claim 18, further comprising a one-touch actuator capable of outputting a fourth signal indicative of a selection of a hands-free exercise routine.

20. A stationary exercise machine, comprising:

a flywheel;

a rotatable crank connected to the flywheel, wherein rotation of the crank translates into rotation of the flywheel;

pedals attached to the crank, wherein the pedals are configured to be being operated at least one pedal cadence during an exercise by a user;

a resistance mechanism configured for interacting with the flywheel to apply resistance to the flywheel, wherein the resistance is translated back to the pedals;

a sensor configured for outputting a first signal indicative of a first pedal cadence at a first time during the exercise and a second signal indicative of a second pedal cadence at a second time during the exercise, wherein the second time follows the first time and the second pedal cadence is different than the first pedal cadence; and a processor configured for receiving the first and second signals and outputting a control signal to cause the resistance mechanism to change from applying a first resistance at the first pedal cadence to applying a second resistance at the second pedal cadence, wherein the processor is further configured for causing the resistance mechanism to maintain the second resistance applied to the flywheel as long as the second pedal cadence is maintained independent of the magnitude of the second pedal cadence.

21. The stationary exercise machine of claim 20, wherein:

the sensor is further configured for outputting a third signal indicative of a third pedal cadence at a third time during the exercise, wherein the third time follows the second time and the third pedal cadence is different than both the second pedal cadence and the first pedal cadence; and the processor is further configured for receiving the second and third signals and outputting a second control signal to cause the resistance mechanism to change from applying the second resistance at the second pedal cadence to applying a third resistance at the third pedal cadence, wherein the processor is further configured for causing the resistance mechanism to maintain the third resistance applied to the flywheel as long as the third pedal cadence is maintained independent of the magnitude of the third pedal cadence.

22. The stationary exercise machine of claim 20, wherein the sensor is configured to monitor rotation of the flywheel to generate the first and second signals.

* * * * *

UNITED STATES PATENT AND TRADEMARK OFFICE

CERTIFICATE OF CORRECTION

PATENT NO. : 7,585,251 B2
APPLICATION NO. : 11/000509
DATED : September 8, 2009
INVENTOR(S) : Doody, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1038 days.

Signed and Sealed this

Fourteenth Day of September, 2010

David J. Kappos

David J. Kappos
*Director of the United States Patent and Trademark Office*